US006425148B1

(12) United States Patent
Chen

(10) Patent No.: US 6,425,148 B1
(45) Date of Patent: Jul. 30, 2002

(54) WATER-SAVING DEVICE FOR A TOILET HAVING A SINK WITH A FLOAT-OPERATED DRAIN VALVE

(76) Inventor: Jung-Hua Chen, No. 134, Yuan Tong South Road, Tan Zi Hsiang, Taichung, Hsien (TW)

( * ) Notice: Subject to any disclaimer, the term of this patent is extended or adjusted under 35 U.S.C. 154(b) by 0 days.

(21) Appl. No.: 09/931,967

(22) Filed: Aug. 17, 2001

(51) Int. Cl.[7] ..... A47K 4/00; E03C 1/01; E03D 9/00

(52) U.S. Cl. ..... 4/665; 4/664

(58) Field of Search ..... 4/664, 665, 378, 4/415

(56) References Cited

U.S. PATENT DOCUMENTS 3,015,827 A * 1/1962 Iwata ..... 4/664
4,163,293 A * 8/1979 Basterfield ..... 4/664
4,646,780 A * 3/1987 Spooner ..... 4/665
5,228,152 A * 7/1993 Fraley ..... 4/664

* cited by examiner

*Primary Examiner*—Gregory Huson
*Assistant Examiner*—Tuan Nguyen
(74) *Attorney, Agent, or Firm*—Alan Kamrath; Rider, Bennett, Egan & Arundel, LLP

(57) ABSTRACT

A water-saving device for a toilet comprises a tank, a tank lid mounted on top of the tank, a sink formed on the sink and communicated with a chamber in the tank via a hole in the sink, and an output tube having a lower end communicated with an inlet tube and an upper end for supplying water into the sink. A guide tube is mounted in the tank and comprises an upper end communicated with the hole of the sink and a lower end immersed in the water in the chamber of the tank such that drainage of water in the sink via the hole of the sink and the guide tube into the chamber of the tank is almost silent.

13 Claims, 9 Drawing Sheets

A – A

WATER-SAVING DEVICE FOR A TOILET HAVING A SINK WITH A FLOAT-OPERATED DRAIN VALVE

BACKGROUND OF THE INVENTION

1. Field of the Invention

The present invention relates to a water-saving device for a toilet.

2. Description of the Related Art

A device has been proposed to save water when using a toilet. The device comprises a sink defined in the tank lid. An output tube has a lower end communicated with an inlet tube in the tank and an upper end with a spout for outputting water. Thus, the user may wash his or her hands in the sink with the water from the spout. A drainage hole is defined in a bottom of the sink for draining used water into the tank for flushing the toilet. However, no plug is provided for plugging the drainage hole such that the water from the spout is drained into the tank immediately. The use of water is not so effective. In addition, the sound of drainage of the water from the sink into the tank via the drainage hole is relatively loud, which would sound even louder when using the toilet in the night.

SUMMARY OF THE INVENTION

An object of the present invention is to provide a water-saving device for a toilet, wherein water is effectively used before it is drained into the tank of the toilet.

Another object of the present invention is to provide a water-saving device for a toilet, wherein drainage of water in the sink into the tank of the toilet is almost silent.

A further object of the present invention is to provide a water-saving device for a toilet, wherein water can be outputted via a spout without flushing the toilet.

In accordance with a first aspect of the invention, a water-saving device for a toilet comprises:

a tank defining a chamber therein, a wall defining the chamber having an outlet for draining water in the chamber of the tank out of the tank;

an inlet tube having an end communicated with a water source;

a tank lid mounted on top of the tank, a sink being formed on the tank lid and comprising a hole-communicated with the chamber of the tank;

an output tube having a first end communicated with the inlet tube and a second end for supplying water into the sink;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover; and a guide tube comprising an upper end communicated with the hole of the sink and a lower end immersed in water in the chamber of the tank.

In accordance with a second aspect of the invention, a water-saving device for a toilet comprises:

a tank defining a chamber therein, a wall defining the chamber having an outlet for draining water in the chamber of the tank out of the tank, an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end communicated with the second end of the filling tube and a second end for supplying water into the sink;

a float arm having a first end pivotally and thus operably connected to the valve and a second end;

a float attached to the second end of the float arm, the float being operably connected to the plug;

wherein when the water in the chamber of the tank is at a high level ready for flushing, the valve is closed to prevent water in the inlet tube from entering the filling tube and the outlet cover is in the non-flushing position;

wherein when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube, the plug being moved to a position preventing drainage of water in the sink via the hole.

In accordance with a third aspect of the invention, a water-saving device for a toilet comprises:

a tank defining a chamber therein, a wall defining the chamber having an outlet for draining water in the chamber of the tank out of the tank;

an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end communicated with the second end of the filling tube and a second end for supplying water into the sink;

a float arm having a first end pivotally and thus operably connected to the valve and a second end;

a float attached to the second end of the float arm;

a guide tube comprising a first section having an upper end communicated with the hole of the sink, an intermediate portion, and a lower end, the guide tube further comprising a second section having an upper end communicated with the intermediate portion of the first section and a lower end immersed in water in the chamber of the tank, the lower end of the guide tube being arranged to prevent drainage of water from the hole of the sink into the chamber of the tank via the lower end of the first section of the guide tube; and a valve stem slidably received in the first section, the valve stem having an upper end securely engaged with the plug and a lower end extending beyond the lower end of the first section for operable connection with the float;

wherein when the water in the chamber of the tank is at a high level ready for flushing, the valve is closed to prevent water in the inlet tube from entering the filling tube and the outlet cover is in the non-flushing position;

wherein when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube, the plug is moved to a position plugging the hole in the sink and thus preventing drainage of water in the sink via the hole; and wherein when the water in the tank reaches a level between the high level and the predetermined level, the valve stem is moved by the float to a position allowing drainage of the water in the sink via the hole of the sink, the first section of the guide tube, and the second section of the guide tube.

In accordance with a fourth aspect of the invention, a water-saving device for a toilet comprises:

a tank defining a chamber therein, a wall defining the chamber having an outlet for draining water in the chamber of the tank out of the tank;

an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end having a first inlet port and a second inlet port and a second end for supplying water into the sink, the second inlet port of the output tube being communicated with the second end of the filling tube;

a float arm having a first end pivotally and thus operably connected to the valve and a second end;

a bypass tube having a first end communicated with the inlet tube and a second end communicated with the first inlet port of the output tube;

a water handle mounted to the first end of the output tube for controlling opening and closing of the first inlet port;

a float attached to the second end of the float arm;

a guide tube comprising a first section having an upper end communicated with the hole of the sink, an intermediate portion, and a lower end, the guide tube further comprising a second section having an upper end communicated with the intermediate portion of the first section and a lower end immersed in water in the chamber of the tank, the lower end of the guide tube being arranged to prevent drainage of water from the hole of the sink into the chamber of the tank via the lower end of the first section of the guide tube; and a valve stem slidably received in the first section, the valve stem having an upper end securely engaged with the plug and a lower end extending beyond the lower end of the first section for operable connection with the float;

wherein when the water handle is in a closed position and when the water in the chamber of the tank is at a high level ready for flushing, the valve is closed to prevent water in the inlet tube from entering the filling tube and the outlet cover is in the non-flushing position, and wherein when the water handle is in an open position, water is outputted via the inlet tube, the bypass tube, and the output tube;

wherein when the water handle is in a closed position and when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube, the plug is moved to a position plugging the hole in the sink and thus preventing drainage of water in the sink via the hole;

wherein when the water handle is in a closed position and when the water in the tank reaches a level between the high level and the predetermined level, the valve stem is moved by the float to a position allowing drainage of the water in the sink via the hole of the sink, the first section of the guide tube, and the second section of the guide tube.

Other objects, advantages, and novel features of the invention will become more apparent from the following detailed description when taken in conjunction with the accompanying drawings.

DETAILED DESCRIPTIONS OF THE PREFERRED EMBODIMENTS

Figure 1:
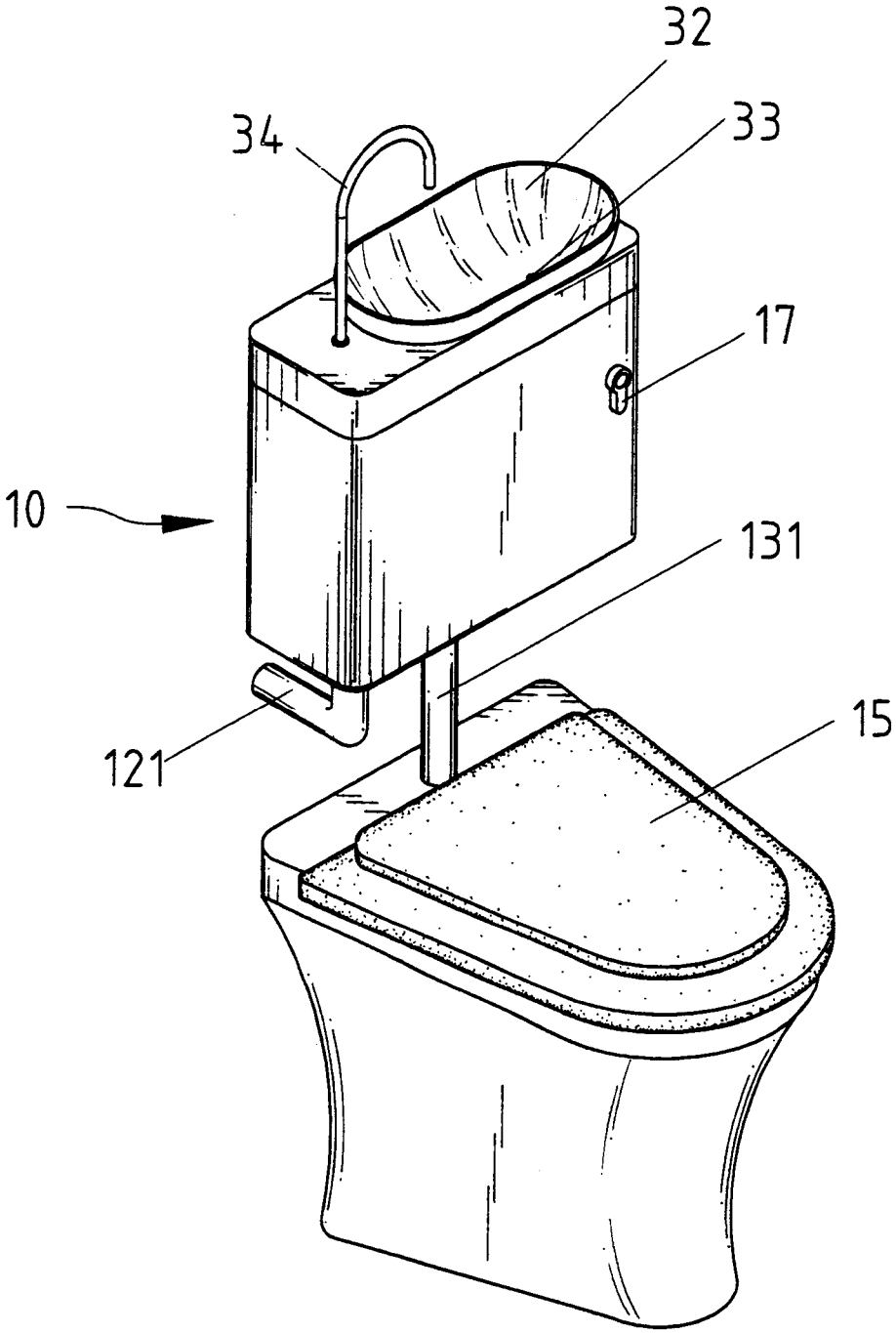
FIG. 1 is a perspective view of a toilet with a water-saving device in accordance with the present invention.
Figure 2:
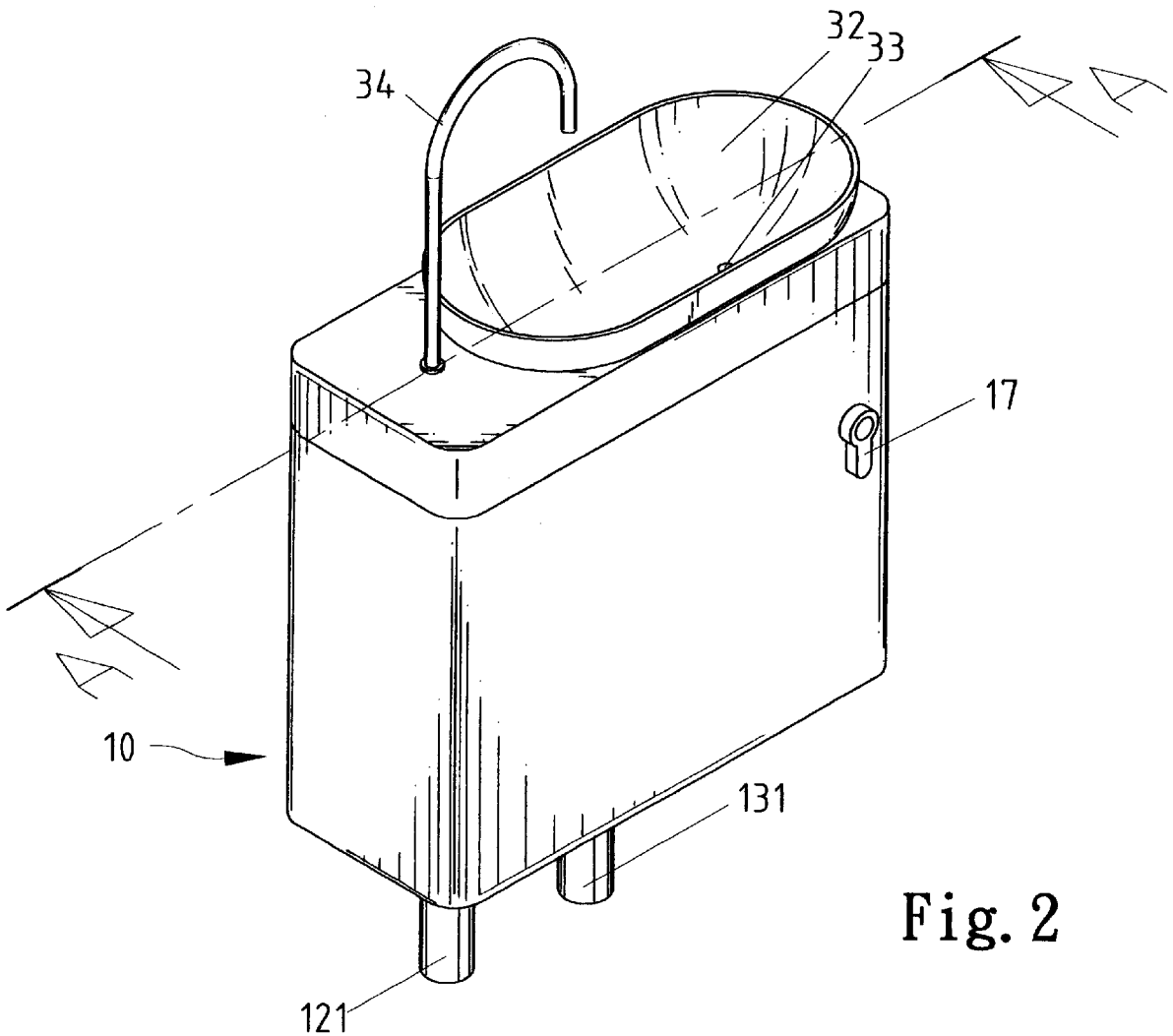
FIG. 2 is a perspective view of the water-saving device in accordance with the present invention.

Referring to FIGS. 1 through 4, a water-saving device in accordance with the present invention generally comprises a tank 10 defining a chamber 11 for receiving water. Defined in a bottom wall defining the chamber 11 is an inlet 12 to which an inlet pipe 121 is connected and an outlet 13 (FIG. 4) to which an outlet tube 131 is connected. An outlet cover 14 is pivotally mounted to the bottom wall defining the chamber 11 for covering the outlet 13 and thus stopping drainage of water from the tank 10 into a bowl 15 (FIG. 1) located below the tank 10.

A flush handle 17 has a threaded stem 171 that extends through a hole 16 in a side of the tank 10 into the chamber 11 and through a hole 181 in an end of a link 18 and is then engaged with a nut 19, thereby pivotally mounting the flush handle 17 to the tank 10. The other end of the link 18 is connected to the outlet cover 14 via a lift wire 182 such that the outlet cover 14 is lifted upward when the flush handle 17 is pivoted, thereby draining water in the tank 10 into the bowl 15. The flush handle 17, the link 18, and the lift wire 182 together form a flushing means.

An inlet tube 20 is mounted in the chamber 11 of the tank 10 and comprises a lower end extended through the inlet 12 and then threadedly engaged with the inlet pipe 121 that is communicated with a water source. A passage 21 is defined in the inlet tube 20. A filling tube 22 has an end communicated with an upper end of the inlet tube 21. At least one transverse hole 22 is defined in the filling tube 22 for filling water into the chamber 11 of the tank 10. A valve 231 is mounted to the upper end of the inlet tube 21 for removably blocking the passage 21. A float arm 23 has a first end pivotally and thus operably connected to the valve 231 and a second end to which a float 232 is securely attached.

A tank lid 30 is mounted on top of the tank 10 and comprises a sink 32 formed on an upper side thereof. The sink 32 is communicated with the chamber 11 of the tank 10 via a hole 33. An output tube 34 has a lower end extended through a hole 31 in the tank lid 30 and an upper end having a spout 35 facing the sink 32. A connecting tube 40 has a first end 42 communicated with to the lower end of the output tube 34 and a second end 41 communicated with the other end of the filling tube 22.

Figure 4:
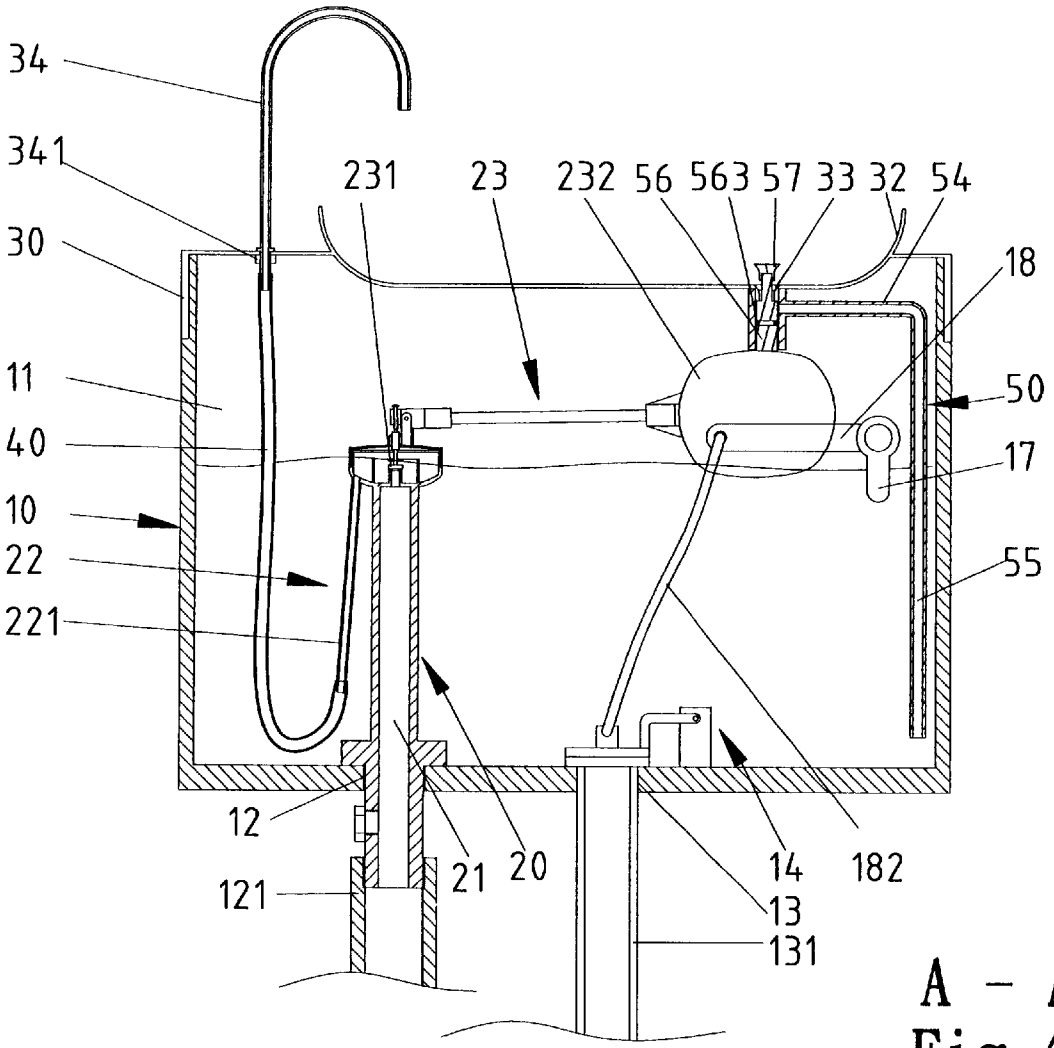
FIG. 4 is a sectional view taken along line A—A in FIG. 2.

A guide tube 50 is mounted in the chamber 11 of the tank 10 and comprises a relatively long vertical section 55, a relatively short vertical section 51, and a horizontal connecting section 54. In this embodiment, the relatively short vertical section 51 is mounted below and communicated with the hole 33 of the sink 32 at an upper end 52 thereof. A lower end 53 of the relatively short vertical section 51 is preferably located above the float 232. A valve stem 56 is slidably mounted in the relatively short vertical section 51 of the guide tube 50 and a plug 57 is attached to a threaded upper end 561 of an upper portion 564 of the valve stem 56. The plug 57 tapers downward and has a maximum diameter greater than an inner diameter of the hole 33 in the sink 32. As illustrated in FIG. 4, the horizontal connecting section 54 of the guide tube 50 has a first end communicated with an intermediate section of the relatively short vertical section 51 and a second end communicated with an upper end of the relatively long vertical section 55. The valve stem 56 comprises an annular groove 562 on a lower portion 565 thereof for receiving an O-ring 563 to thereby prevent from drainage of water from the hole 33 into the chamber 11 of the tank 10 via the lower end 565 of the valve stem 56.

Before flushing, as illustrated in FIG. 4, the float 232 is in a substantially horizontal position and at a high level under the action of buoyancy. It is noted that the lower end 565 of the valve stem 56 is moved upward by the float 232 to a position in which the plug 57 is above the hole 33 of the sink 32 while the first end of the connecting section 54 is blocked by the lower end 565 of the valve stem 56. In addition, the valve 231 is in a closed position preventing the water from the passage 21 from entering the filling tube 22.

Figure 5:
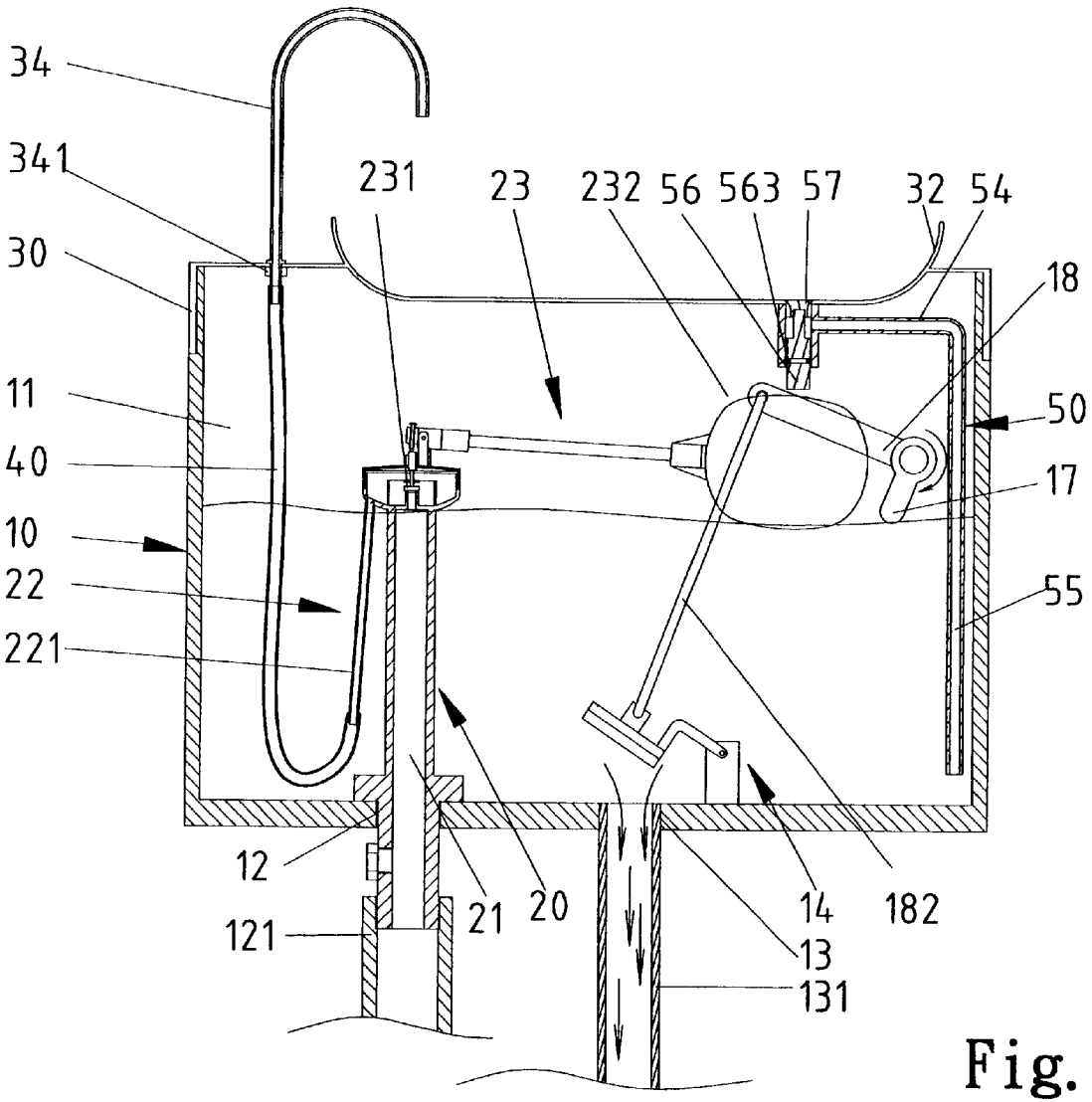
FIG. 5 is a sectional view similar to FIG. 4, illustrating operation in the tank.

Referring to FIG. 5, when the flush handle 17 is pivoted, the outlet cover 14 is lifted, the water in the chamber 11 of the tank 10 flows via the outlet tube 131 into the bowl 15, and the float 232 moves downward along with the lowering water level in the tank 10. The valve stem 56 moves downward under the action of gravity, as it is no longer supported by the float 232. As illustrated in FIG. 5, the plug 57 is in a position blocking the hole 33 in the sink 32. Downward movement of the float 232 also causes opening of the valve 231 to thereby allow the water from the passage 21 to enter the filling tube 22.

Figure 6:
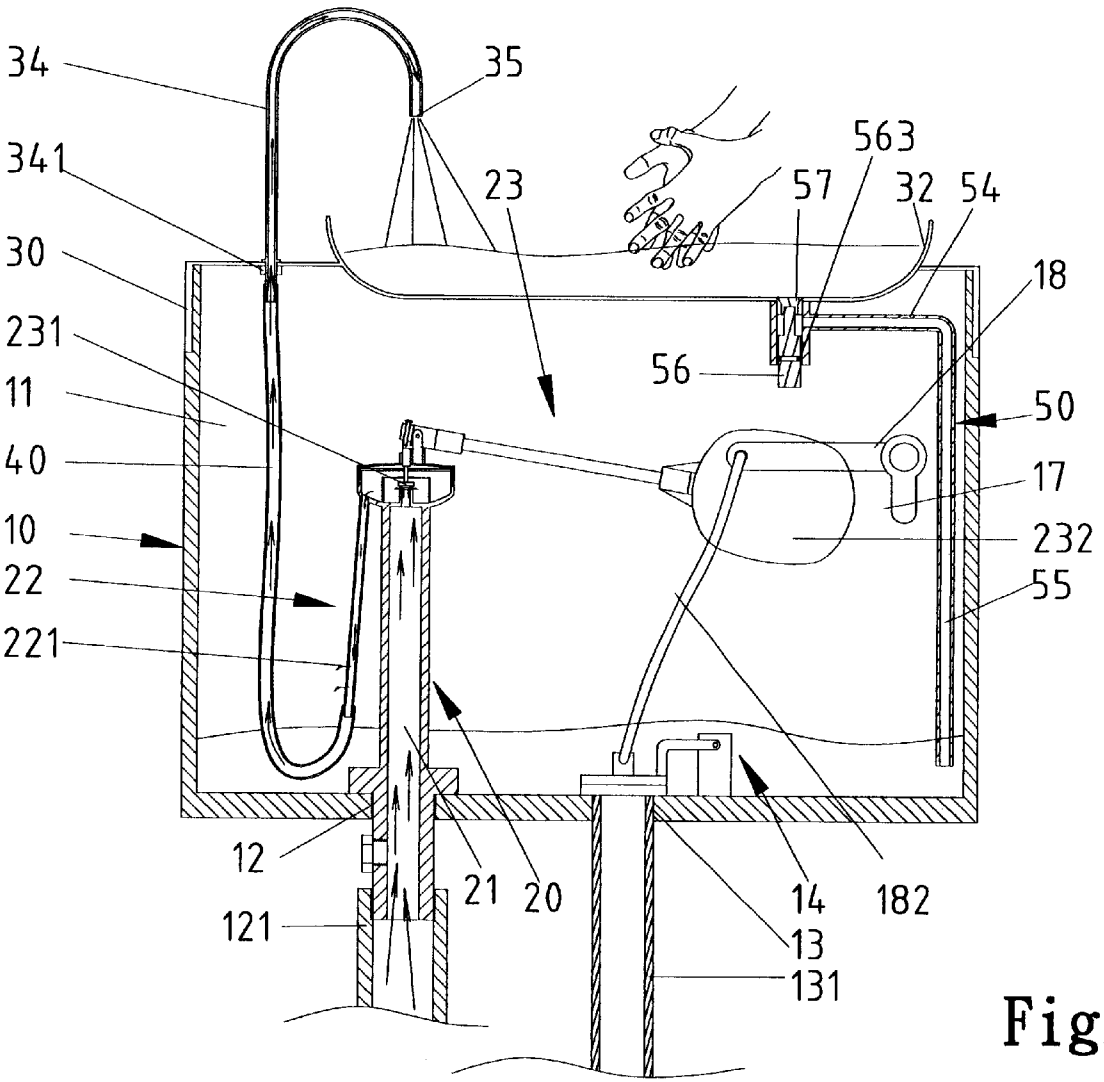
FIG. 6 is a sectional view similar to FIG. 5, illustrating supply of water after flushing.

Referring to FIG. 6, when the flush handle 17 is released, the outlet cover 14 moves back to its initial position under the action of gravity to thereby stop draining of water via the outlet tube 131 of the tank 10. Water from the inlet pipe 121 enters the passage 21 and then the filling tube 22, as the valve 231 is open. A portion of the water entering the filling tube 22 flows into the chamber 11 of the tank 10 via the transverse holes 221 of the filling tube 22. The remaining portion of the filling tube 22 is outputted via the spout 35 after passing through the connecting tube 40 and the output tube 34. As illustrated in FIG. 6, the water from the spout 35 is accumulated in the sink 32 for effective use by the user, as the hole 33 in the sink 32 is blocked by the plug 57.

Figure 7:
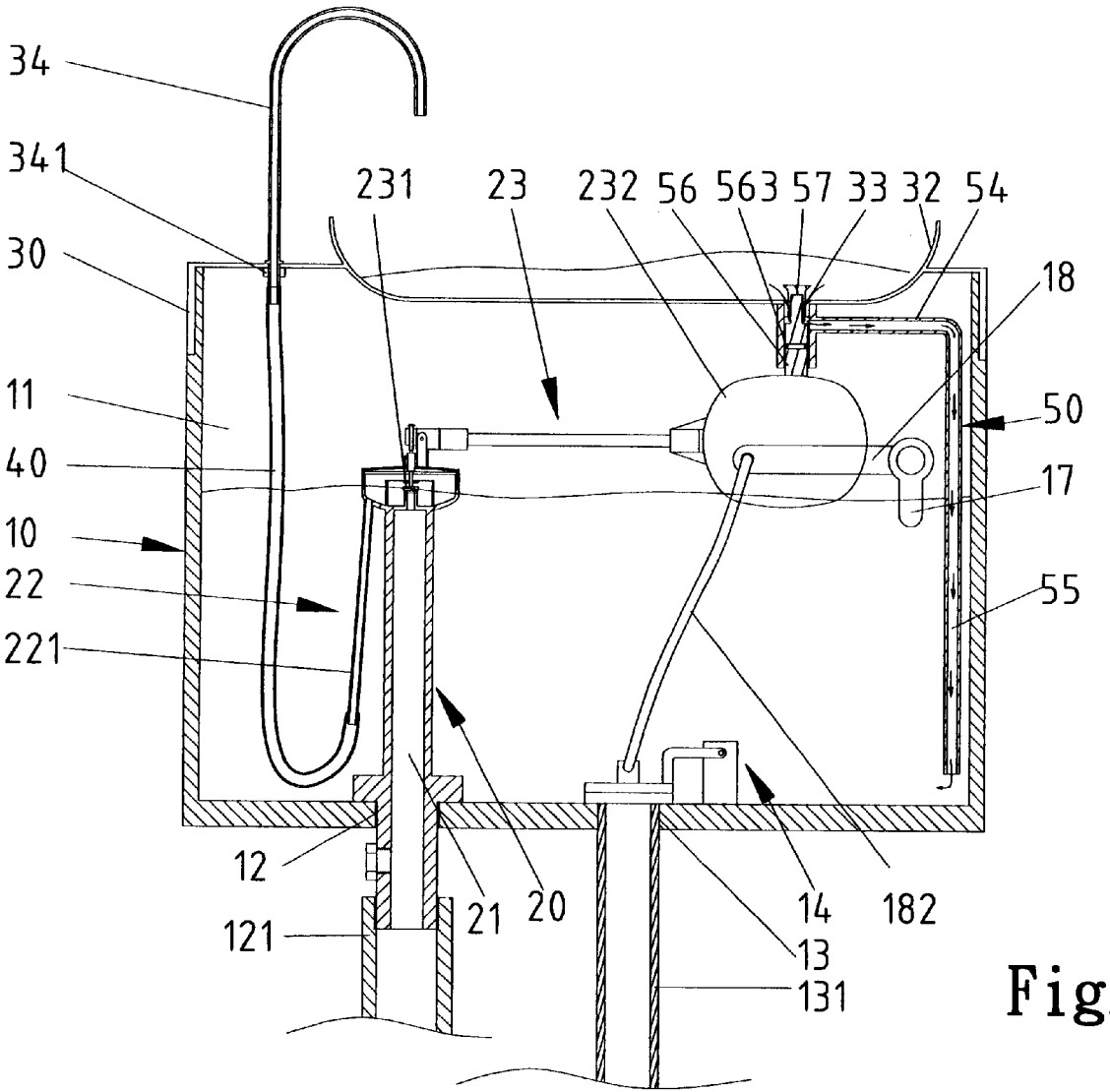
FIG. 7 is a sectional view similar to FIG. 6, illustrating drainage of water from the sink into the toilet tank.

Referring to FIG. 7, when the water flowing into the chamber 11 of the tank 10 reaches a first predetermined level, the float 232 is moved upward, which, in turn, moves the valve stem 56 upward. Thus, the plug 57 is moved upward and thus no longer blocks the hole 33 while the first end of the connecting section 54 is not blocked. The upper end 564 of the valve stem 56 has a diameter smaller than the inner diameter of the hole 33 of the sink 32 to allow drainage of water in the sink 32 via the hole 33 and the first end of the connecting section 54. As a result, the used water in the sink 32 flows into the chamber 11 of the tank 10 via the hole 33 in the sink 32, the relatively shorter vertical section 51, the connecting section 54, and the relatively longer vertical section 55, as indicated by the arrows in FIG. 7. The lower end of the relatively longer 55 is immersed in the water in the chamber 11 of the tank 10 such that the drainage of the water in the sink 32 into the tank 10 is almost silent. When the water in the chamber 11 of the tank 10 reaches a second predetermined level above the first predetermined level, the float 232 is moved further upward, which, in turn, moves the valve stem 56 further upward to a level that the first end of the connecting portion 54 is blocked by the lower end 565 of the valve stem 56, as shown in FIG. 4. The toilet is now ready for next flushing.

Figure 3:
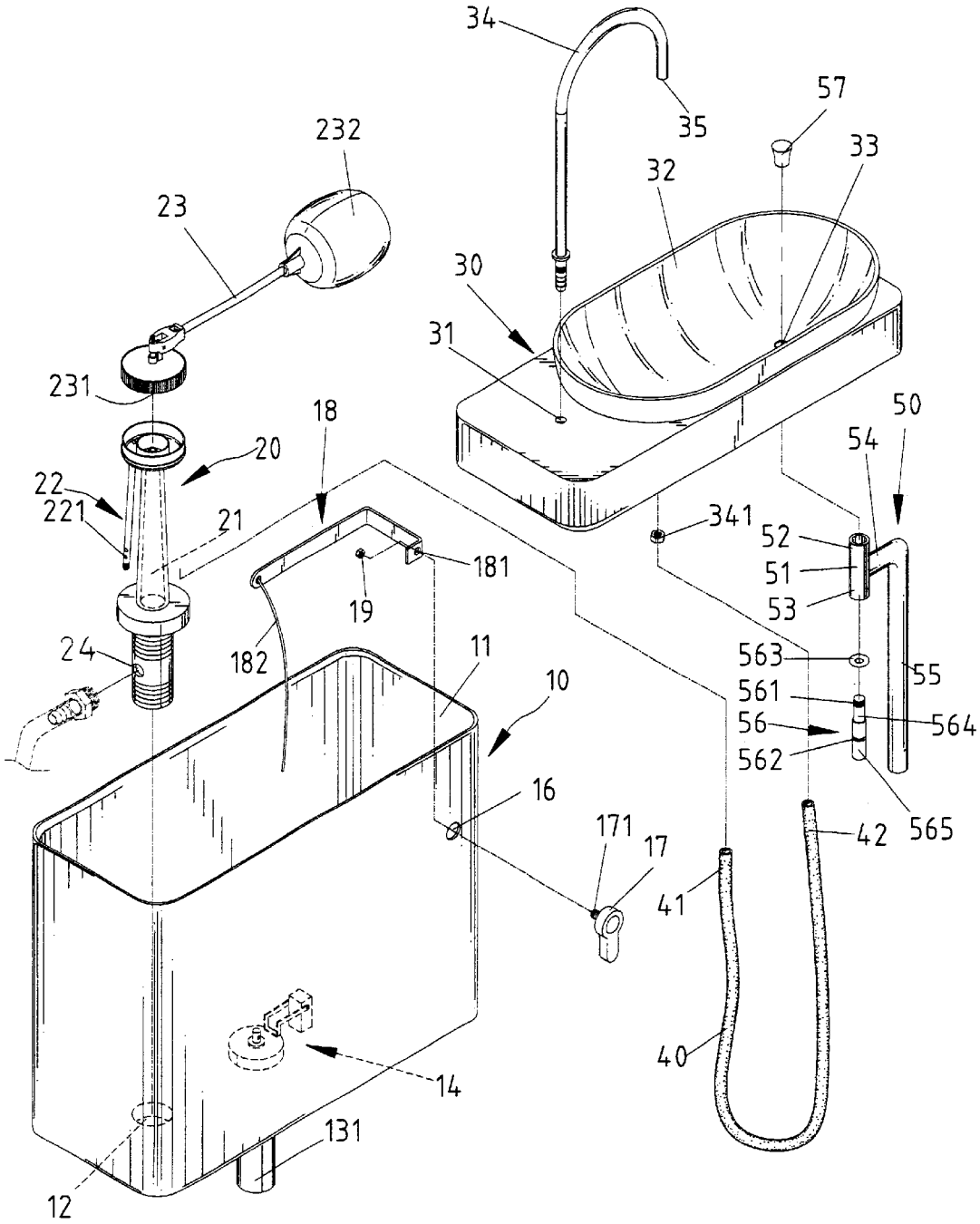
FIG. 3 is an exploded perspective view of the water-saving device in accordance with the present invention.

Referring to FIG. 3, the lower end of the inlet tube 20 may include a transverse hole 24 for optional connection to an external water source when required. In a simplified embodiment of the invention, the valve stem 56 is omitted, and the guide tube 50 comprises an upper end directly communicated with the hole 33 of the sink 32 and a lower end immersed in the water in the chamber 11 of the tank 10. In addition, the plug 57 is manually inserted into the hole 33 of the sink 32 for washing hands or other purpose. In another modified embodiment of the invention, the relatively shorter vertical section 51 can be deemed as a first section, and the connecting section 54 and the relatively longer vertical section 55 can be deemed as a second section having an upper end communicated with an intermediate section of the first section and a lower end immersed in the water in the tank 10.

Figure 8:
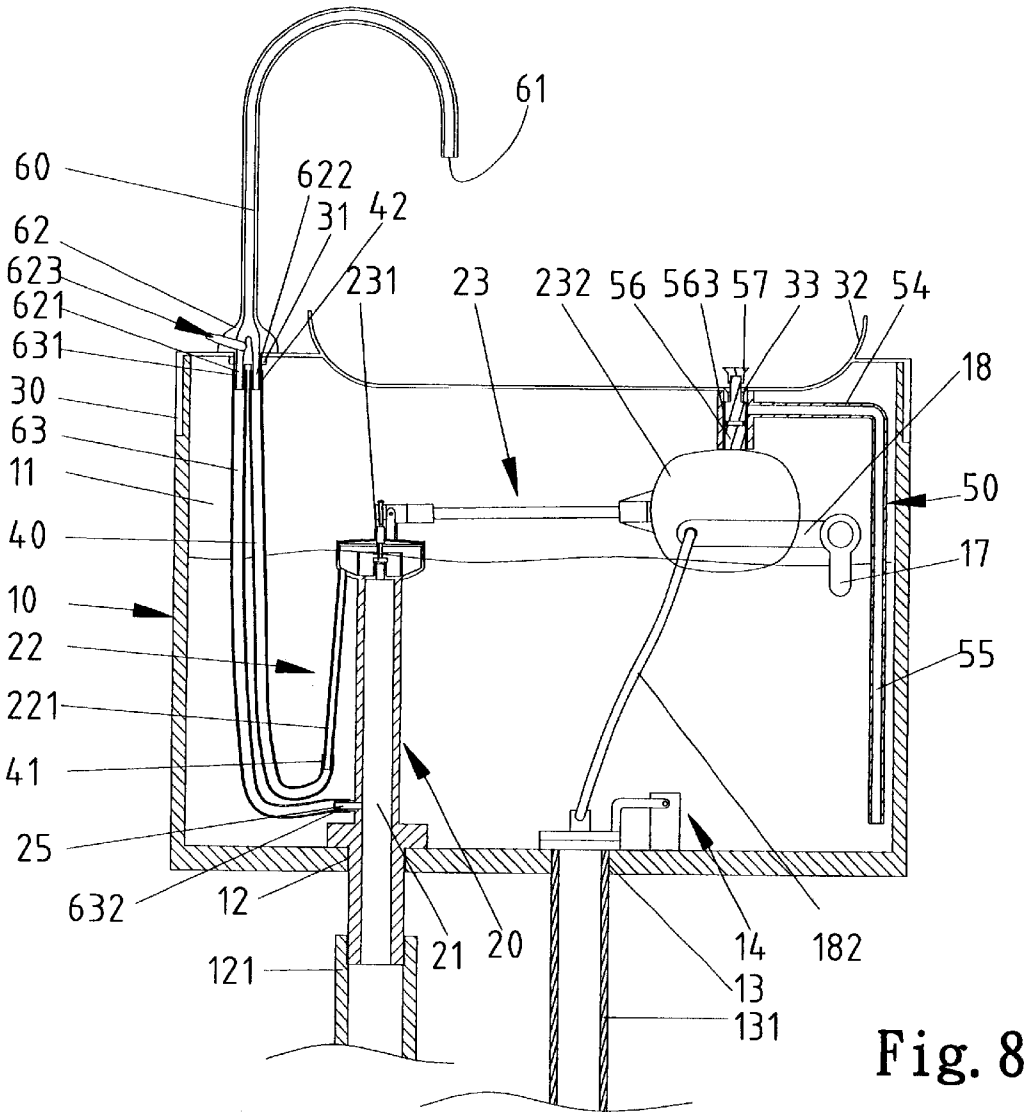
FIG. 8 is a sectional view illustrating a modified embodiment of the water-saving device in accordance with the present invention.
Figure 9:
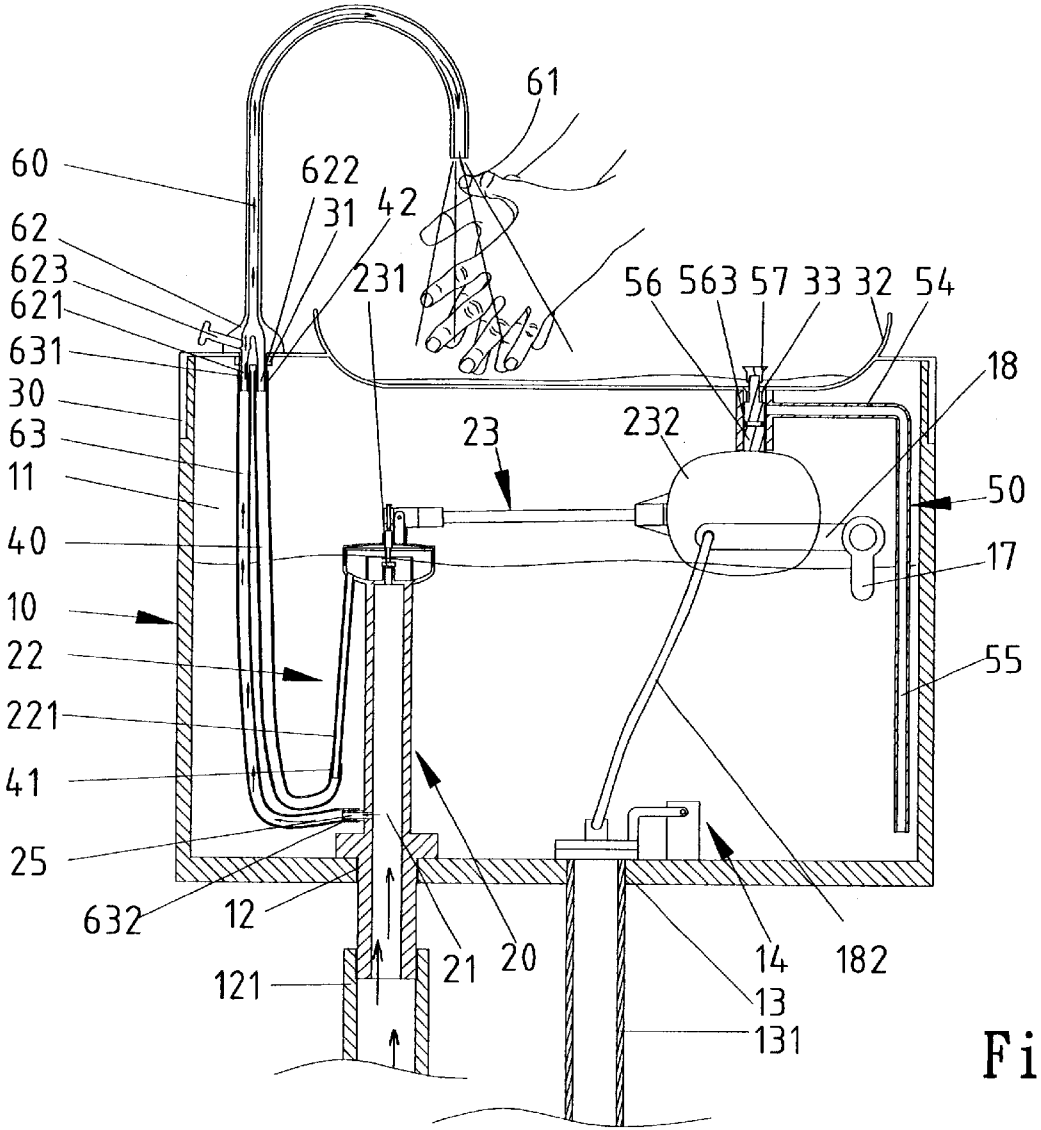
FIG. 9 is a sectional view illustrating use of the water-saving device in FIG. 8.

FIG. 8 illustrates a modified embodiment of the water-saving device in accordance with the present invention, wherein the output tube (now designated by 60) has an upper end having a spout 61 facing the sink 32 and a lower end 62 extended through the hole 31 in the tank lid 30. The lower end 62 of the output tube 60 comprises a first inlet port 621 to which a water handle 623 is attached and a second inlet port 622 to which the first end 42 of the connecting tube 40 is connected. The second end 41 of the connecting tube 40 communicated with the other end of the filling tube 22. In addition, a further connecting tube 63 is provided in which a first end 631 of the connecting tube 63 is connected to the first inlet port 621 and a second end 632 of the connecting tube 63 is connected to a bypass pipe 25 formed on the inlet tube 20. By such an arrangement, even no flushing action is taken, the user may wash his or her hands by switching the water handle 623 to an output position, as the water will be fed via the bypass pipe 25, the connecting tube 63, and the output tube 60.

According to the above description, it is appreciated that the water flowing into the sink 32 is effectively used before it is drained into the chamber 11 of the tank 10. The used water in the sink 32 is automatically drained into the chamber 11 of the tank 10 without causing noise. The user needs not to manually turn on/off the faucet in conventional toilet for washing hands, as water is automatically supplied into the sink 32 via the output tube 34. Plugging movement is also automatically achieved by the plug 57 under control of the float 232 and the valve stem 56. Sanitary improvement is thus provided.

Although the invention has been explained in relation to its preferred embodiment, it is to be understood that many other possible modifications and variations can be made without departing from the scope of the invention as hereinafter claimed.

What is claimed is:

1. A water-saving device for a toilet, comprising:

a tank defining a chamber therein, a wall defining the chamber having an outlet for draining water in the chamber of the tank out of the tank;

an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end communicated with the second end of the filling tube and a second end for supplying water into the sink;

a float arm having a first end pivotally and thus operably connected to the valve and a second end;

a float attached to the second end of the float arm;

wherein when the water in the chamber of the tank is at a high level ready for flushing, the valve is closed to prevent water in the inlet tube from entering the filling tube and the outlet cover is in the non-flushing position;

wherein when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube and a plug being moved to a position preventing drainage of water in the sink via the hole by the float.

2. The water-device as claimed in claim 1, wherein the inlet tube further comprises a transverse hole outside the tank for communication with an external water source.

3. The water-saving device as claimed in claim 1, further comprising means for moving the outlet cover between the flushing position and the non-flushing position.

4. The water-saving device as claimed in claim 3, wherein the means for moving the outlet cover between the flushing position and the non-flushing position comprises a flush handle pivotally mounted to the tank, a link having a first end connected to the flush handle and a second end, and a lift wire having a first end connected to the second end of the link and a second end connected to the outlet cover.

5. A water-saving device for a toilet, comprising:

a tank defining a chamber therein, a wall defining the chamber having an outlet for draining water in the chamber of the tank out of the tank;

an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end communicated with the second end of the filling tube and a second end for supplying water into the sink;

a float arm having a first end pivotally and thus operably connected to the valve and a second end;

a float attached to the second end of the float arm;

a guide tube comprising a first section having an upper end communicated with the hole of the sink, an intermediate portion, and a lower end, the guide tube further comprising a second section having an upper end communicated with the intermediate portion of the first section and a lower end immersed in water in the chamber of the tank, the lower end of the guide tube being arranged to prevent drainage of water from the hole of the sink into the chamber of the tank via the lower end of the first section of the guide tube; and a valve stem slidably received in the first section, the valve stem having an upper end securely engaged with a plug and a lower end extending beyond the lower end of the first section;

wherein when the water in the chamber of the tank is at a high level ready for flushing, the valve is closed to prevent water in the inlet tube from entering the filling tube and the outlet cover is in the non-flushing position;

wherein when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube, the plug is moved to a position plugging the hole in the sink by the float and thus preventing drainage of water in the sink via the hole; and wherein when the water in the tank reaches a level between the high level and the predetermined level, the valve stem is moved by the float to a position allowing drainage of the water in the sink via the hole of the sink, the first section of the guide tube, and the second section of the guide tube.

6. The water-saving device as claimed in claim 5, wherein the inlet tube further comprises a transverse hole outside the tank for communication with an external water source.

7. The water-saving device as claimed in claim 5, further comprising means for moving the outlet cover between the flushing position and the non-flushing position.

8. The water-saving device as claimed in claim 7, wherein the means for moving the outlet cover between the flushing position and the non-flushing position comprises a flush handle pivotally mounted to the tank, a link having a first end connected to the flush handle and a second end, and a lift wire having a first end connected to the second end of the link and a second end connected to the outlet cover.

9. The water-saving device as claimed in claim 5, wherein the plug tapers downward and has a maximum diameter greater than an inner diameter of the hole in the sink.

10. The water-saving device as claimed in claim 9, wherein the upper end of the first section of the guide tube has an outer diameter smaller than the inner diameter of the hole in the sink.

11. The water-saving device as claimed in claim 9, wherein the lower end of first section of the guide tube comprises an annular groove, further comprising an O-ring received in the annular groove of the lower end of the first section to thereby prevent drainage of water from the hole of the sink into the chamber of the tank via the lower end of the first section of the guide tube.

12. A water-saving device for a toilet, comprising:

a tank defining a chamber therein, a wall defining the chamber having an outlet for draining water in the chamber of the tank out of the tank;

an inlet tube having a first end communicated with a water source and a second end;

a tank lid mounted on top of the tank, a sink being formed on the tank lid and comprising a hole communicated with the chamber of the tank;

an outlet cover mounted to the tank for covering the outlet, the outlet cover being movable between a flushing position in which the outlet of the tank is not covered by the outlet cover to thereby allow drainage of water in the chamber via the outlet and a non-flushing position wherein the outlet of the tank is covered by the outlet cover;

a valve mounted on the second end of the inlet tube;

a filling tube having a first end communicated with the second end of the inlet tube and a second end, the filling tube further having at least one transverse hole;

an output tube having a first end having a first inlet port and a second inlet port and a second end for supplying water into the sink, the second inlet port of the output tube being communicated with the second end of the filling tube;

a float arm having a first end pivotally and thus operably connected to the valve and a second end;

a bypass tube having a first end communicated with the inlet tube and a second end communicated with the first inlet port of the output tube;

a water handle mounted to the first end of the output tube for controlling opening and closing of the first inlet port;

a float attached to the second end of the float arm;

a guide tube comprising a first section having an upper end communicated with the hole of the sink, an intermediate portion, and a lower end, the guide tube further comprising a second section having an upper end communicated with the intermediate portion of the first section and a lower end immersed in water in the chamber of the tank, the lower end of the guide tube being arranged to prevent drainage of water from the hole of the sink into the chamber of the tank via the lower end of the first section of the guide tube; and a valve stem slidably received in the first section, the valve stem having an upper end securely engaged with a plug and a lower end extending beyond the lower end of the first section;

wherein when the water handle is in a closed position and when the water in the chamber of the tank is at a high level ready for flushing, the valve is closed to prevent water in the inlet tube from entering the filling tube and the outlet cover is in the non-flushing position, and wherein when the water handle is in an open position, water is outputted via the inlet tube, the bypass tube, and the output tube;

wherein when the water handle is in a closed position and when the water in the chamber of the tank is lowered to a predetermined level after flushing, the valve is opened to allow the water in the inlet tube to enter the filling tube, a portion of the water from the filling tube entering the chamber of the tank via said at least one transverse hole, a remaining portion of the water from the filling tube entering the sink via the second end of the filling tube and the outlet tube, the plug is moved to a position plugging the hole in the sink by the float and thus preventing drainage of water in the sink via the hole;

wherein when the water handle is in a closed position and when the water in the tank reaches a level between the high level and the predetermined level, the valve stem is moved by the float to a position allowing drainage of the water in the sink via the hole of the sink, the first section of the guide tube, and the second section of the guide tube.

13. The water-saving device as claimed in claim 12, wherein the plug tapers downward and has a maximum diameter greater than an inner diameter of the hole in the sink.

* * * * *